US009670743B2

(12) United States Patent
Karlsson

(10) Patent No.: US 9,670,743 B2
(45) Date of Patent: Jun. 6, 2017

(54) ROCK DRILL MACHINE WITH FEED LEG

(71) Applicant: ATLAS COPCO CONSTUCTION TOOLS AB, Stockholm (SE)

(72) Inventor: Magnus Karlsson, Ljungbyholm (SE)

(73) Assignee: CONSTRUCTION TOOLS PC AB, Kalmar (SE)

( * ) Notice: Subject to any disclaimer, the term of this patent is extended or adjusted under 35 U.S.C. 154(b) by 219 days.

(21) Appl. No.: 14/379,368

(22) PCT Filed: Feb. 11, 2013

(86) PCT No.: PCT/SE2013/050108
§ 371 (c)(1),
(2) Date: Aug. 18, 2014

(87) PCT Pub. No.: WO2013/122532
PCT Pub. Date: Aug. 22, 2013

(65) Prior Publication Data

US 2015/0027784 A1 Jan. 29, 2015

(30) Foreign Application Priority Data

Feb. 17, 2012 (SE) ..... 1250139

(51) Int. Cl.
*E21B 19/087* (2006.01)
*E21B 19/086* (2006.01)
*E21B 7/02* (2006.01)

(52) U.S. Cl.
CPC ..... *E21B 19/087* (2013.01); *E21B 7/025* (2013.01); *E21B 7/027* (2013.01); *E21B 19/086* (2013.01)

(58) Field of Classification Search
CPC ... E21B 19/087; E21B 19/086; E21D 20/003; F02B 63/02; B25D 9/16; B25D 17/04
See application file for complete search history.

(56) References Cited

U.S. PATENT DOCUMENTS 1,569,542 A * 1/1926 Gartin ..... E21B 19/086 173/158
1,662,791 A * 3/1928 Gartin ..... E21B 19/086 173/161

(Continued)

FOREIGN PATENT DOCUMENTS

SE 320344 B 2/1970

OTHER PUBLICATIONS

PCT/ISA/210—International Search Report—May 24, 2013 (Issued in PCT/SE2013/050108).

*Primary Examiner* — Kipp Wallace
(74) *Attorney, Agent, or Firm* — Venable LLP; Jeffri A. Kaminski

(57) ABSTRACT

A rock drill machine with a feed leg. The feed leg is attached to the rock drill machine with one end and rests on a support with another end. The feed leg is configured to feed the rock drill machine in a drilling direction and to interrupt feeding of the rock drill machine in the drilling direction. A control regulates the feed leg and a starter activates the rock drill machine. The control is provided on a rear handle in close proximity to the starter such that the control and the starter can be reached at the same time with one hand. Hereby, it is possible, with one hand, to activate and interrupt activation of the rock drill machine respectively, and simultaneously regulate the feed leg to feed the rock drill machine in the drilling direction and interrupt the feeding of the rock drill machine in the drilling direction.

13 Claims, 6 Drawing Sheets

(56) References Cited

U.S. PATENT DOCUMENTS

| | | | | | |
|---|---|---|---|---|---|
| 1,808,481 | A * | 6/1931 | Slater | B25D 9/16 | 173/170 |
| 2,165,904 | A * | 7/1939 | Osgood | E21B 19/086 | 173/157 |
| 2,617,629 | A * | 11/1952 | Robinson | E21B 19/087 | 173/170 |
| 2,908,482 | A | 10/1959 | Curtis et al. | | |
| 3,011,569 | A * | 12/1961 | Dick | E21B 19/087 | 173/158 |
| 3,065,806 | A | 11/1962 | Thompson | | |
| 3,085,638 | A | 4/1963 | August | | |
| 3,132,703 | A * | 5/1964 | Larcen | E21B 19/087 | 173/158 |
| 3,191,692 | A * | 6/1965 | Ekwall | B25D 9/16 | 137/530 |
| 3,203,489 | A * | 8/1965 | Fuehrer | E21B 19/087 | 173/158 |
| 3,533,477 | A | 10/1970 | Ekwall | | |
| 6,176,016 | B1 * | 1/2001 | Higashi | A01D 34/90 | 30/276 |
| 6,581,568 | B2 * | 6/2003 | Kramer | A01D 34/90 | 123/179.18 |
| 6,752,221 | B1 * | 6/2004 | Morissette | B25D 17/28 | 173/193 |
| 9,375,832 | B2 * | 6/2016 | Boeck | B25F 5/00 | |

* cited by examiner

ROCK DRILL MACHINE WITH FEED LEG

CROSS-REFERENCE TO RELATED APPLICATIONS

This application claims priority to Swedish patent application 1250139-1 filed 17 Feb. 2012 and is the national phase under 35 U.S.C. §371 of PCT/SE2013/050108 filed 11 Feb. 2013.

TECHNICAL FIELD

The present invention relates to a manually operated rock drill machine with a feed leg. The feed leg is attached to the rock drill machine with one end and rests on a support with the other end. The feed leg is configured to feed the rock drill machine in a drilling direction and to interrupt feeding of the rock drill machine in the drilling direction respectively. A control is provided to regulate the feed leg and a starter is provided to activate the rock drill machine.

BACKGROUND OF THE INVENTION

In order to facilitate drilling with manual powerful rock drill machines, a feed leg is used to support the rock drill machine as well as to provide feeding power to and counteract forces of reaction from the rock drill machine. Normally, the feed leg is with one end attached to the rock drill machine directly under said rock drill machine, while the other, opposite end is configured with e.g. a foot by means of which the feed leg rests against the ground. The feed leg normally comprises a cylinder pipe, a piston, a piston rod, a control and means for feeding a compressed medium to and into the cylinder pipe on the respective side of the piston therein. Depending on which side of the piston the pressure medium is fed, the piston rod is driven out of or into the cylinder pipe. The feed leg can be pneumatically or hydraulically operated. The control for the feed leg is traditionally located directly on the feed leg, but there are other solutions, and a starter for the rock drill machine is found on top thereof, which means that one can not reach the controls without moving the hands therebetween.

At collaring, i.e. when drilling of a hole is started, one has to control the feed leg and smoothly start the rock drill machine while you at the same time lift the rock drill machine for positioning the drill. This can be difficult to do with the control for the feed leg and the starter for the rock drill machine at a distance from each other.

SUMMARY OF THE INVENTION

An object of the present invention is consequently to provide a rock drill machine with feed leg wherein the control for the feed leg and the starter for the rock drill machine are gathered such that they can be operated with one and the same hand without moving the hand.

This is achieved according to the present invention by providing the control for regulating the feed leg to feed the rock drill machine in a drilling direction and to interrupt feeding of the rock drill machine in the drilling direction respectively, on a rear handle on the rock drill machine in close connection to the starter for the rock drill machine such that said control and said starter can be reached at the same time with one hand. According to the invention, the starter also comprises an arm which is configured for pivotal movement from a start position at which the rock drill machine is inoperative, in a direction towards the rock drill machine for activation thereof, and the control on the rear handle on the rock drill machine is more exactly provided substantially directly above or obliquely above and, seen in the drilling direction, in front of at least a part of the arm when said arm is in start position.

The construction described above provides for better ergonomics, security and control and collaring is facilitated. The control is protected from external violence and unintentional operation.

BRIEF DESCRIPTION OF THE DRAWINGS

The rock drill machine with feed leg according to the present invention will be further described below with reference to the accompanying drawings, in which FIG. 1 schematically illustrates a prior art rock drill machine and a feed leg.

DETAILED DESCRIPTION OF PREFERRED EMBODIMENTS

Figure 1:
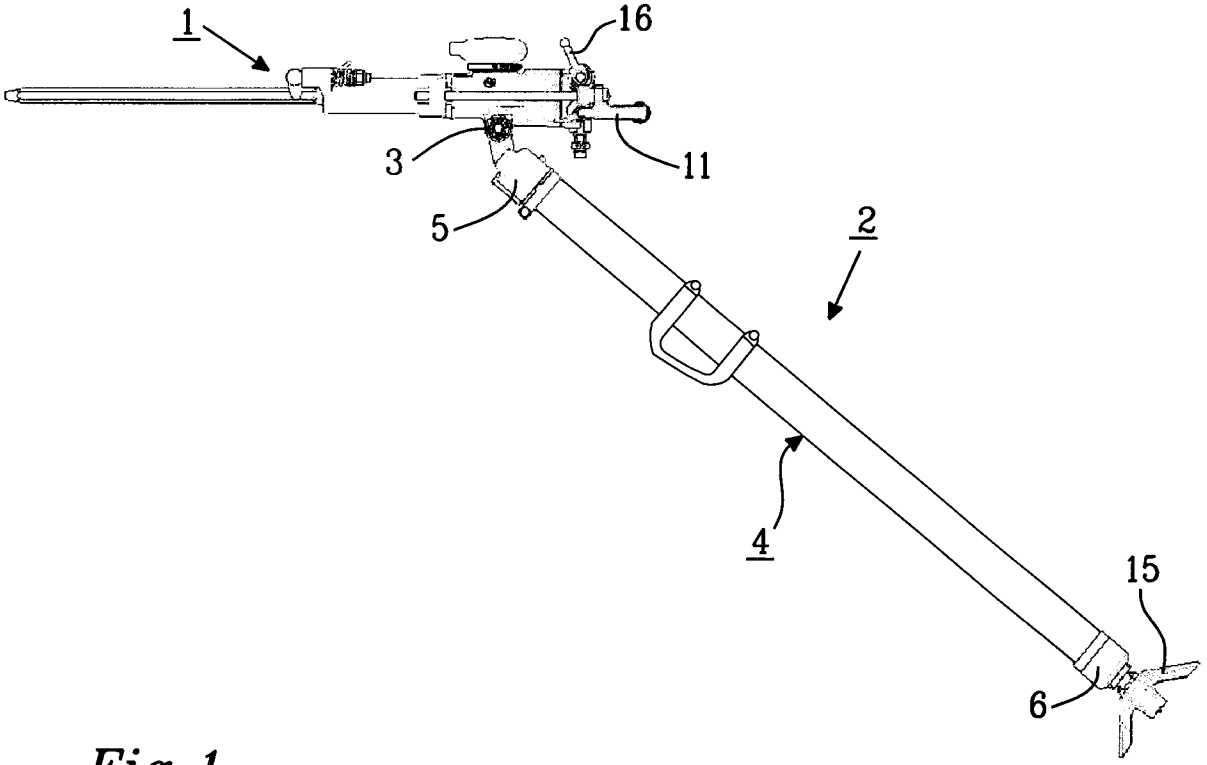

The present invention relates to, as is already stated above, a manual rock drill machine with a feed leg. A prior art manual, handheld rock drill machine is schematically illustrated in FIG. 1. The rock drill machine is in FIG. 1 given the general reference numeral 1. A feed leg 2 is through a goose-neck coupling 3 with one end attached to the underside of the rock drill machine 1, such that the rock drill machine can move, i.e. turn and rotate relative to the feed leg. Other types of connections can also be used. The feed leg 2 is used to give support to the rock drill machine 1 and to provide feeding power to and counteract forces of reaction from the rock drill machine during drilling. The other end of the feed leg 2, opposite to the end connected to the rock drill machine 1, may thus be configured with a foot of a suitable type to support the rock drill machine in the best way and by means of which one can brace against the support upon which the rock drill machine rests through the feed leg.

Figure 2:
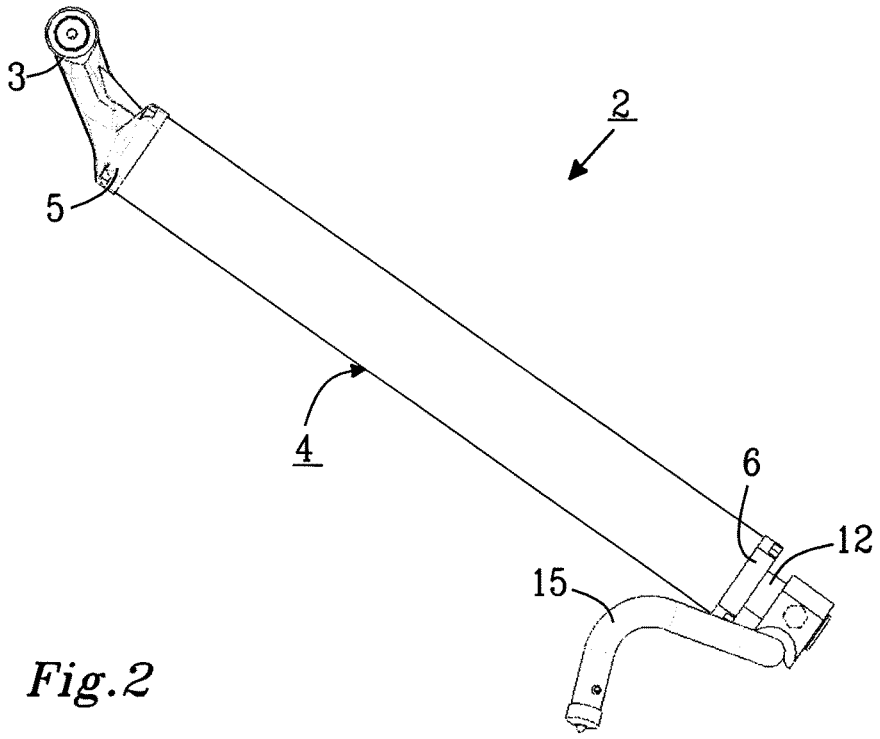
FIG. 2 is a schematic perspective view of a feed leg.
Figure 3:
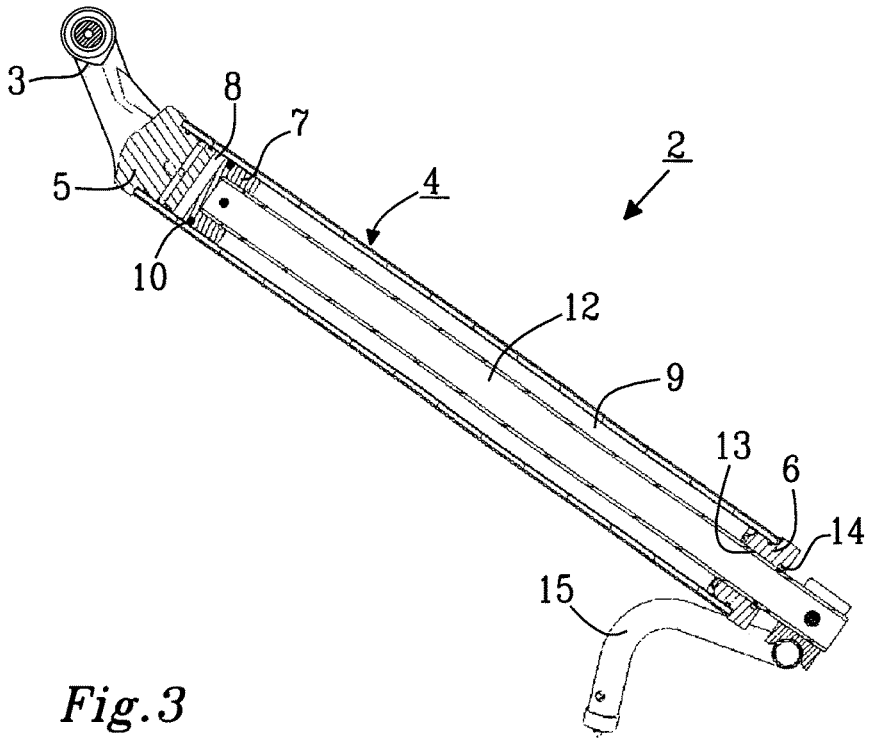
FIG. 3 is a schematic sectional view through the feed leg of FIG. 2.

As mentioned, the feed leg 2 is configured, during drilling, to feed the rock drill machine 1 in a drilling direction, but also, when required, interrupt the feeding of the rock drill machine in the drilling direction. The feeding of the rock drill machine in the drilling direction is interrupted e.g. when the feed leg 2 shall be moved for retake for a new drilling sequence or when further drilling shall not be performed. The feed leg 2 of substantially prior art construction per se, comprises in the illustrated embodiment according to FIGS. 2 and 3 a cylinder pipe 4. The cylinder pipe 4 is closed at the end portions by means of end pieces 5 and 6, of which the end piece 5 is provided with the goose-neck coupling 3 for connection to the rock drill machine 1. A piston 7 is movably provided in the cylinder pipe 4. The piston 7 defines a space 8 and 9 respectively, for a pressurized medium in the cylinder pipe 4 on each side of the piston. A sealing 10 is provided on the piston 7 to prevent the pressurized medium from flowing from one space 8, 9 to the other by passing between the piston and the inner side of the cylinder pipe 4. The sealing 10 consists e.g. of an O-ring of a suitable material. The feed leg 2 further comprises a supply means 24 (see FIG. 7) for guiding or feeding the pressurized medium to the spaces 8, 9 therefor in the cylinder pipe 4. A control 11 by means of which the pressurized medium is guided or fed to the space 8 or 9 for the pressurized medium on one or the other side of the piston 7, is provided on the rock drill machine 1, in the illustrated embodiment according to FIG. 1 at the rear of the machine. A piston rod 12 connected to the piston 7 is through the influence of the pressurized medium on said piston movable out of and into the cylinder pipe 4 respectively, in order to, as indicated above, feed the rock drill machine 1 in the drilling direction and to interrupt said feeding of the rock drill machine in the drilling direction. To this end, the piston rod 12 extends out of the cylinder pipe 4 through an opening 13 in the end piece 6. A suitable sealing 14 is also provided in the opening 13 for preventing the pressurized medium from leaving the space 9 by passing between the piston rod 12 and said opening. The piston rod 12 is in the outer end thereof, outside the cylinder pipe 4, configured with a support in the form of e.g. two legs 15, as in FIGS. 2 and 3. However, the number of support legs may vary. There are embodiments with one leg, but also with four legs, as in FIG. 1. The pressurized medium can be brought from a pressurized-medium source 25 (see FIG. 7) and the pressurized medium can be fed to the feed leg 2 e.g. through the control 11, the coupling 3 and the end piece 5. The supplied pressurized medium has normally a pressure of about 5 bars. The pressurized medium may also be used for cooling the rock drill machine 1 during operation, for removing drill cuttings etc. Filling of pressurized medium on the pressurized-medium source 25 may be carried through via e.g. a filling conduit 26. The filling conduit 26 may alternatively be connected directly to the control 11. A starter 16 for activating the rock drill machine 1 and for interrupting this activation is in FIG. 1 provided on top of the machine.

Figure 4:
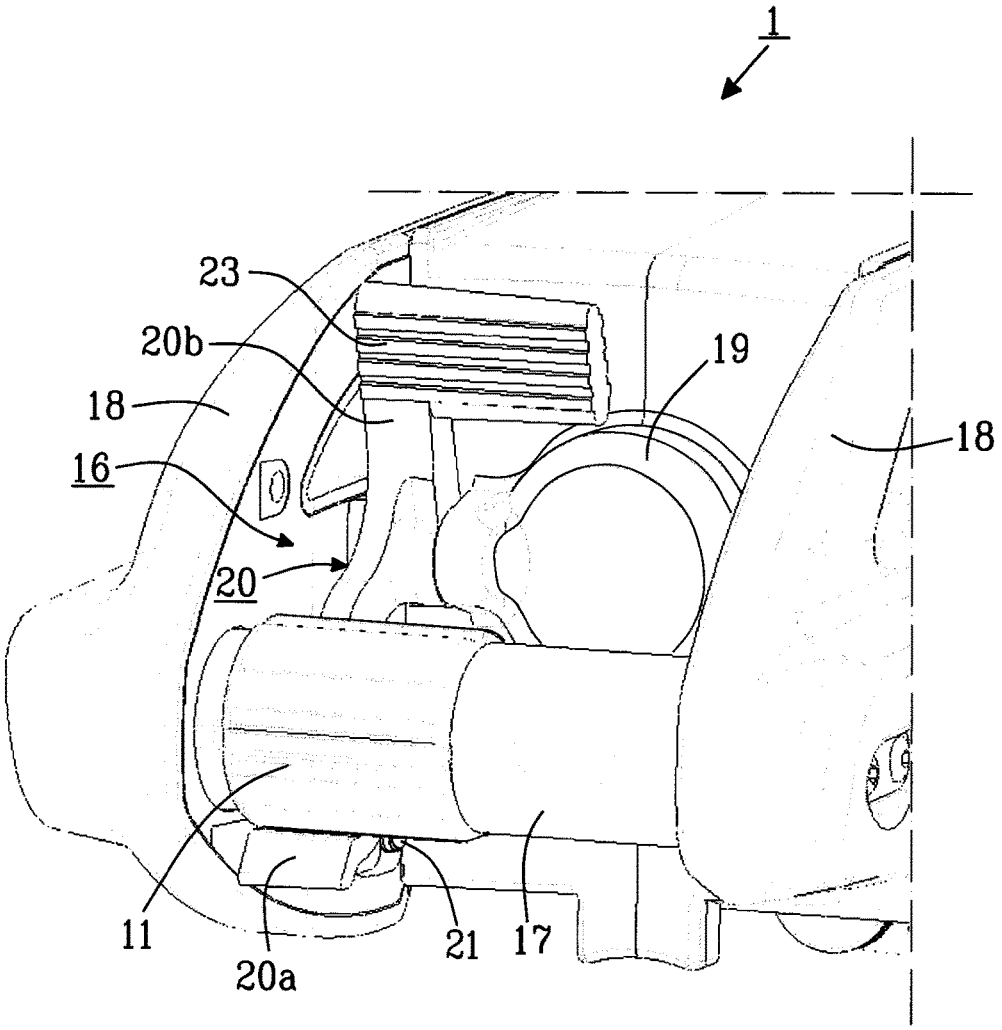
FIG. 4 is a schematic perspective view of a rear portion of a rock drill machine which is configured as according to the present invention.
Figure 5:
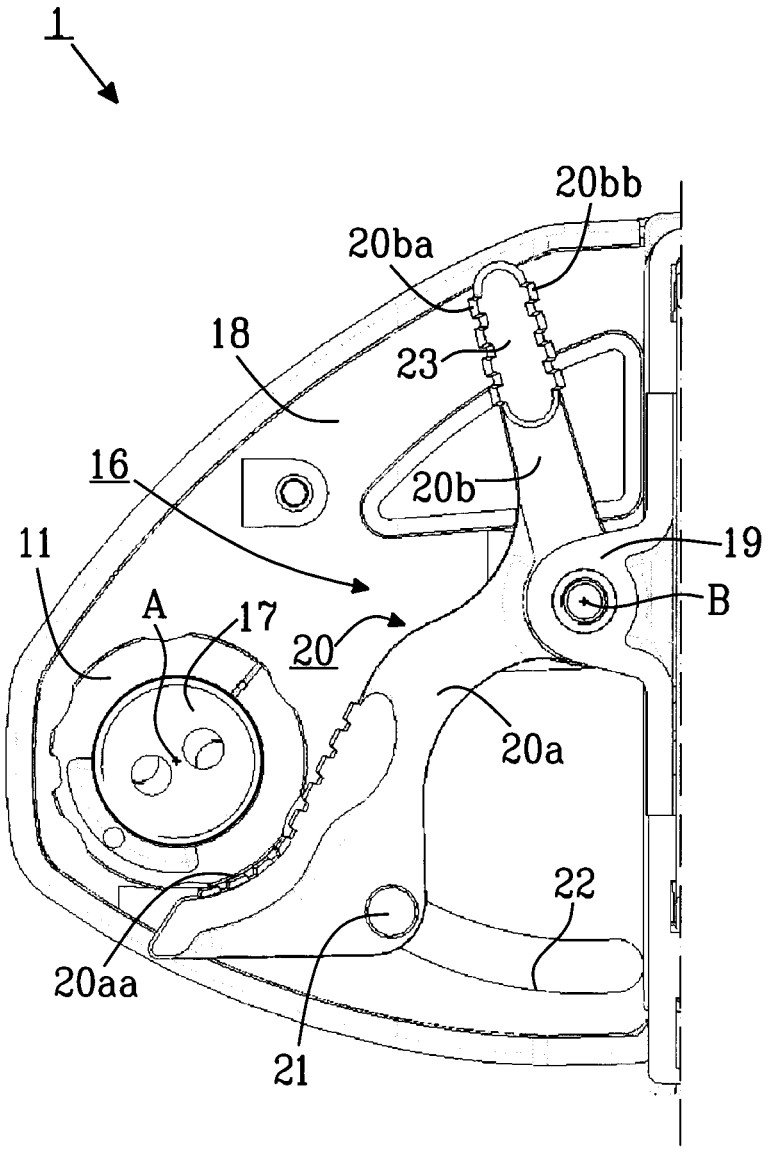
FIG. 5 is a schematic side view of the rear portion of the rock drill machine and illustrates the starter in start position.
Figure 6:
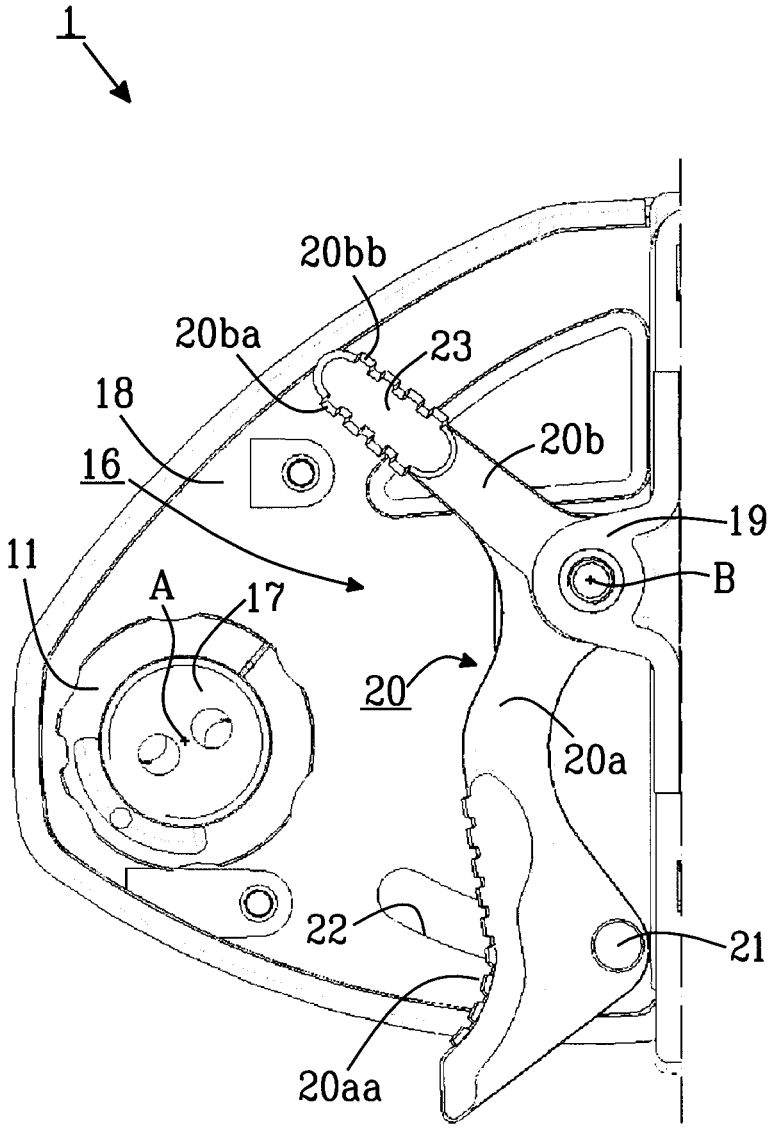
FIG. 6 is a schematic side view corresponding to FIG. 5 of the rear portion of the rock drill machine and illustrates the starter when the rock drill machine is fully activated.

In FIG. 4-6 is, according to the present invention, the control 11 for the feed leg 2 and the starter 16 for the rock drill machine 1 provided in another way than in FIG. 1 in order to facilitate operation of the feed leg and rock drill machine. As is apparent from FIG. 4-6, the control 11 for regulating the feed leg 2 for feeding the rock drill machine 1 in the drilling direction and for interrupting said feeding of the rock drill machine in the drilling direction respectively, or, in other words, for guiding or feeding the pressurized medium to the respective space 8, 9 on one or the other side of the piston 7 for displacement of the piston rod 12 out of and into the cylinder pipe 4 respectively, is now provided on a rear handle 17 on the rock drill machine in close connection to the starter 16 for the rock drill machine, such that said control and said starter can be reached at the same time with one hand for activating and interruption of the activation of the rock drill machine respectively, while simultaneously regulating the feed leg to feed the rock drill machine in the drilling direction and interrupt the feeding of the rock drill machine in the drilling direction respectively.

At the embodiment illustrated in FIG. 4, the control is configured as a twist control 11 which is rotatably provided on the handle 17, i.e. rotatable about an axis A which extends centrally through the handle 17 in the longitudinal direction thereof. The control 11 however, may also be configured otherwise in view of the intended purpose thereof. The handle 17 extends between and is mounted on two shanks 18 of the back of the rock drill machine 1. The shanks 18 are preferably configured such that they provide protection for the control 11, the starter 16 and the hand of the operator on the handle 17. The starter 16 for the rock drill machine 1 is in turn pivotally mounted on a portion 19 of the back of the rock drill machine 1 which projects out somewhat between said shanks 18 within the handle 17 with the twist control 11, i.e. between the back and the handle if seen in the intended drilling direction. The starter 16 can pivot about an axis B which extends through said portion 19 of the back. The starter 16 comprises an arm 20 which is configured for pivotal movement about the axis B such that the arm is manually displaceable from a start position illustrated in FIGS. 4 and 5 in which the rock drill machine 1 is inoperative, in a direction towards the rock drill machine for activation thereof, and the twist control 11 for the feed leg 2 is provided substantially directly above or obliquely above and in front of at least a part of the arm 20 when said arm is in start position, e.g. any or a few centimeters over or obliquely over and, seen in the intended drilling direction, in front of the arm or said portion thereof when the arm is in start position, i.e. that the twist control in other words is located between the operator and the arm and preferably at such distance from the arm that there is room for the hand of the operator between the arm and the handle with the twist control.

The arm 20 can be preloaded in a direction towards the start position, but is normally not.

At the embodiment illustrated in FIG. 4-6, the arm 20 is pivotally mounted on the portion 19 of the back substantially centrally on the arm, thereby defining two arm portions 20*a* and 20*b*, one lower and one upper arm portion on the respective side of the pivoting axis B, which when the arm is moved or displaced about the axis B, move in opposite directions. The lower arm portion 20*a* is in the start position illustrated in FIGS. 4 and 5 situated at least partly under or obliquely under and, seen in the intended drilling direction, behind the twist control 11 for the feed leg 2 in close proximity to the twist control, i.e. very close to or just one or two centimeters from the twist control and may thereby, if desired, be preloaded towards the start position in a suitable manner. In order not to take up too much room, the arm 20 may be configured such that the portions 20*a*, 20*b* thereof extend at an angle relative to each other, as in FIG. 4-6, according to which the lower arm portion 20*a* is angled a second time in order to come optimally close to the handle 17 with the twist control 11 and in optimum position in relation thereto. This means e.g. that the lower arm portion 20*a* in the start position is situated at such distance from the twist control 11 that the operator can get his or her thumb or fore finger in between said arm portion and the control or at even closer distance from the control when said lower arm portion at least partly projects down under or obliquely under and, seen in the intended drilling direction, behind the control to such extent that it is within easy reach of the operator. The upper arm portion 20*b* may in start position according to FIGS. 4 and 5 be found in a position e.g. 5-8 centimeters from the twist control 11 or resting against the back within the handle 17 with the twist control 11, whereby the start position is set also for the lower arm portion 20*a*. When the rock drill machine is fully activated, as according to FIG. 6, the upper arm portion 20*b* may take a position at least partly over or obliquely over and, seen in the drilling direction, behind the twist control 11 in close proximity thereto, i.e. a few centimeters (e.g. 3-5 centimeters) from the twist control and between said twist control and the rock drill machine. The lower arm portion 20*a* may then be situated about 4-7 centimeters from the twist control 11.

Without moving the hand from the handle 17 and the twist control 11 for the feed leg 2 provided thereon, the starter 16 for the rock drill machine 1 will then be easily accessible for activation also of the rock drill machine. The operator only has to move the thumb or fore finger from the twist control 11 to the arm 20 of the starter 16, e.g. to the lower portion 20*a* of the arm, and press the arm/arm portion in a direction towards the rock drill machine, e.g. to the position according to FIG. 6 which illustrates the starter 16 with fully activated rock drill machine or to a position somewhere between the start position and the position at full activation.

The arm 20/arm portion 20*a* can be provided with a guide means, e.g. a guide pin 21 which runs in a groove 22 in at least one of the shanks 18 of the back of the rock drill machine 1. This in order to guide and thereby stabilize the starter 16/arm 20 during the displacement or movement thereof. The guide pin 21 is also connected to an articulated arm (not shown) which controls a valve for activating and deactivating the rock drill machine respectively.

The starter 16 may as indicated above be preloaded towards the start position according to FIGS. 4 and 5. This may occur through the guide pin 21 or the articulated arm in connection thereto and a spring means affecting the guide pin or the articulated arm. The guide pin 21 or the articulated arm may be preloaded towards the start position by means of a compression spring or an extension spring. Alternatively, the starter 16 may be preloaded towards the start position according to FIGS. 4 and 5 by means of e.g. a spring means (not shown) which is provided in a suitable manner in connection to the pivoting axis B for affection thereof. The spring means may be a spring which is provided at or about a pivot pin (not shown) defining the pivot axis B and by means of which the arm is mounted in the portion 19 of the back of the rock drill machine 1. Another alternative is to configure the upper arm portion 20*b* with a counterweight (e.g. at 23) which thanks to its weight retracts the upper arm portion 20*b* substantially in the drilling direction and thereby moves or displaces the lower arm portion 20*a* in substantially the opposite direction, back to the start position according to FIGS. 4 and 5. The upper arm portion 20*b*/counter weight may thereby, in start position, be brought to engage the rear of the rock drill machine 1. If the embodiment with the counter weight shall work, it is important that said counter weight, seen from the side, never is located between the pivoting axis B of the arm 20 and the handle 17 with the twist control 11.

As mentioned above however, the arm 20 is normally not preloaded towards the start position such that during drilling it will not be necessary to continuously press the arm or alternatively, the lower arm portion 20*a*, in a direction towards the rock drill machine in order to keep the machine in operation. The part of the upper arm portion 20*b* designated with 23 may thereby instead be configured to facilitate return of the arm to the start position by pressing back said arm portion substantially in the drilling direction without having to release the grip about the handle 17 with the twist control 11. This is possible since the lower arm portion 20*a*, during pivoting of the arm 20, is brought to move away from the handle 17 with the twist control 11, whereby the upper arm portion 20*b* is displaced towards the handle with the twist control. With correct configuration and/or angle of the arm portions 20*a*, 20*b* relative to each other, e.g. with an angle at the embodiment of FIG. 4-6 of about 80° or somewhat more than 80° at the pivoting axis B, the upper arm portion 20*b* may at the embodiment of FIG. 4-6 thereby be brought very close to the twist control 11, as is mentioned above e.g. just any or a few centimeters from said twist control. Alternatively, if this is easier depending on in which position the arm is situated, the arm 20 may down below or alternatively, the lower arm portion 20*a*, may be configured such that the operator with e.g. the thumb or the fore finger easily can grip the arm for retracting said arm in a direction towards the handle to the start position without having to release the grip about the handle 17 with the twist control 11. To facilitate this, the arm 20 may down below or alternatively, the lower arm portion 20*a*, may be configured with one or more surfaces 20*aa* of a grip-friendly material. The upper arm portion 20*b* may also be configured with one or more surfaces 20*ba*, 20*bb* of a grip-friendly material.

Figure 7:
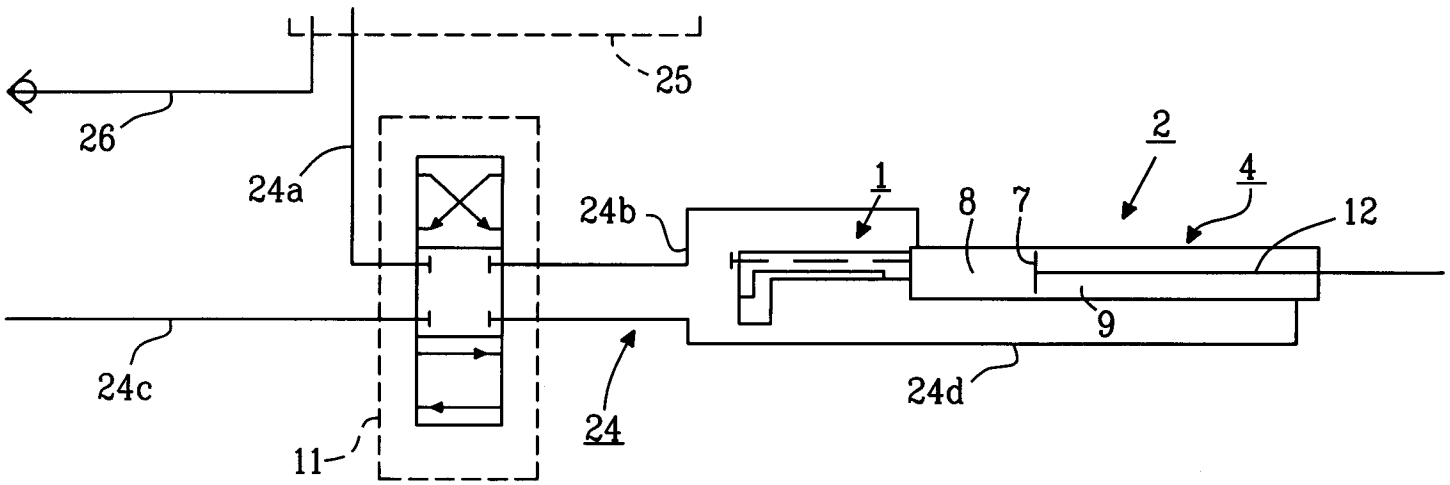
FIG. 7 is a schematic flow chart showing how the feed leg can be operated.

The function of the embodiment of the feed leg 2 described above and illustrated in the drawings is as follows, with reference to FIG. 7:

When the rock drill machine 1 during drilling is fed in the drilling direction, the flow of pressurized medium is controlled by means of the twist control 11 such that the pressurized medium from the source 25 thereof or directly from the filling conduit 26, through at least one supply passage or conduit 24*a* and through at least one passage or conduit 24*b* to the supply means 24, flows into the space 8 on that side of the piston which is facing the rock drill machine, but not into the space 9 on that side of the piston which is facing away from the rock drill machine. The twist control 11 is then regulated or set in a position in which the flow of pressurized medium therethrough is fed as is schematically illustrated in the lowermost part thereof in FIG. 7. This results in, relatively seen, that the piston 7 and thereby the piston rod 12, is displaced out of the cylinder pipe 4 in a direction away from the rock drill machine 1 by the pressurized medium. With the support for the feed leg 2 as a counterstay, the cylinder pipe 4 is thereby pressed in the opposite direction towards the rock drill machine 1 and the rock drill machine is driven in the drilling direction by means of the cylinder pipe. The space 9 is at the same time connected to at least one drain passage or conduit 24*c* through at least one further passage or conduit 24*d* to the supply means 24, or to the pressurized-medium source 25 through said passages.

If on the other hand the feeding of the rock drill machine 1 in the drilling direction shall be interrupted in order to permit movement of the feed leg for retake for a new drilling sequence or when drilling no longer shall be performed, the twist control 11 is regulated or set such that the pressurized medium flows out of the space 8 through the passage 24*b* and the drain passage or conduit 24*c* and the flow of pressurized medium is instead through the supply passage 24*a* and the further passage or conduit 24*d* to the supply means 24 fed into the space 9 on that side of the piston which is facing away from the rock drill machine. Then, the twist control 11 is set in a position where the flow of pressurized medium therethrough is fed as is schematically illustrated in the uppermost part thereof in FIG. 7. This results in, relatively seen, that the piston 7 and thereby the piston rod 12 is displaced into the cylinder pipe 4 in a direction towards the rock drill machine 1 by the pressurized medium. The feed leg 2 is thereby contracted and the rock drill machine can be withdrawn from the drilled hole if no further drilling shall be performed or the feed leg be moved for retake for a new drilling sequence.

If drilling shall be started again or alternatively, proceed after retake, the twist control 11 is again regulated or set such that the pressurized medium flows out of the space 9 through the passage 24*d* and the drain passage 24*c* and the flow of the pressurized medium is again fed into the space 8 through the supply passage 24*a* and the passage 24*b*.

The drain passage 24*c* may be connected to the pressurized-medium source 25 for reuse of the pressurized medium in question.

Resets or regulations of the twist control 11, as well as manoeuvring of the starter 16, during collaring as well as during drilling, are easy to perform with one hand by means of a rock drill machine as defined above.

It is obvious to a skilled person that the rock drill machine according to the present invention can be modified and altered within the scope of the subsequent claims without departing from the idea and purpose of the invention. Thus, as already stated, the control 11 can be configured in other ways than as a twist control. The starter 16 may also be configured otherwise. It is e.g. obvious that the starter 16 does not need to be configured as an angled arm 20, but may also be straight and even pivotally mounted at one end thereof. At such an embodiment, it is important that the arm 20 is accessible in all positions if it is not preloaded towards the start position. If the arm 20 is angled, the angle may vary extensively and the various arm portions 20*a*, 20*b* may be configured and/or angled additionally to save space and to see to that the positions of the arm portions relative to the handle 17 with the twist control 11 ergonomically is as advantageous as possible and, if the arm is not preloaded towards the start position, at least one of the arm portions becomes easily accessible in all positions of the arm from the start position to the position of full activation of the rock drill machine.

The invention claimed is:

1. A rock drill machine, comprising:

a feed leg, wherein the feed leg is attached to the rock drill machine with a first end and rests on a support with a second end, wherein the feed leg is configured to feed the rock drill machine in a drilling direction and to interrupt feeding of the rock drill machine in the drilling direction respectively, a control configured to regulate the feed leg, a starter configured to activate the rock drill machine, wherein the starter comprises an arm which is configured for pivotal movement from a start position at which the rock drill machine is inoperative, in a direction towards the rock drill machine for activation thereof, a rear handle on which the control is provided, wherein the rear handle is arranged on the rock drill machine substantially directly above or obliquely above and, seen in a drilling direction, in front of at least a part of the arm when said arm is in start position such that said control and said starter can be reached at the same time with one hand a guide configured to guide the arm during pivoting thereof, and wherein the arm comprises an articulated arm for activating and deactivating the rock drill machine, wherein the guide is connected to the articulated arm.

2. The rock drill machine according to claim 1, wherein the control for the feed leg is configured as a twist control.

3. The rock drill machine according to claim 1, further comprising:

two shanks arranged on a back of the rock drill machine, wherein the rear handle extends between and is mounted on the two shanks.

4. The rock drill machine according to claim 1, wherein the arm is preloaded in a direction towards said start position.

5. The rock drill machine according to claim 4, further comprising:

a spring configured to preload the arm in a direction towards said start position, wherein the spring is provided in connection to an axis about which the arm is pivotally mounted for affecting said axis.

6. The rock drill machine according to claim 1, further comprising:

a spring operatively connected to the guide to affect the guide, wherein the spring is configured to preload the arm in a direction towards said start position.

7. The rock drill machine according to claim 1, further comprising:

a spring provided in operatively connected to said articulated arm to affect said articulated arm, wherein the spring is configured to preload the arm in a direction towards the start position.

8. The rock drill machine according to claim 1, wherein the arm is pivotally mounted centrally thereon and defines two arm portions which during pivotal movement of the arm move in opposite directions.

9. The rock drill machine according to claim 8, wherein one arm portion at the start position is situated at least partly under or obliquely under and, seen in the intended drilling direction, behind the control for the feed leg in close proximity to the control, the rock drill machine further comprising:

a counter weight operatively connected to the other arm portion and configured to preload the one arm portion towards said start position.

10. The rock drill machine according to claim 8, wherein one arm portion at the start position is situated at least partly under or obliquely under and, seen in the intended drilling direction, behind the control for the feed leg in close proximity to the control, and wherein the other arm portion, when the rock drill machine is fully activated, is situated at least partly over or obliquely over and, seen in the drilling direction, behind said control in close proximity thereto.

11. The rock drill machine according to claim 8, wherein the arm portions extend at an angle relative to each other.

12. The rock drill machine according to claim 11, wherein the arm portions extend at an angle of about 80° or more than 80° relative to each other.

13. The rock drill machine according to claim 3, wherein the arm is pivotally mounted on a portion of the back which is configured between the shanks on which the handle with the control for the feed leg is mounted.

* * * * *